US007311150B2

(12) United States Patent
Zupanick

(10) Patent No.: US 7,311,150 B2
(45) Date of Patent: Dec. 25, 2007

(54) METHOD AND SYSTEM FOR CLEANING A WELL BORE

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 206 days.

(21) Appl. No.: 11/018,775

(22) Filed: Dec. 21, 2004

(65) Prior Publication Data

US 2006/0131029 A1 Jun. 22, 2006

(51) Int. Cl.
*E21B 21/00* (2006.01)

(52) U.S. Cl. ..... 166/311; 166/312; 166/372

(58) Field of Classification Search ..... 166/372, 166/311, 312
See application file for complete search history.

(56) References Cited

U.S. PATENT DOCUMENTS

| | | | | |
|---|---|---|---|---|
| 3,971,437 | A | 7/1976 | Clay et al. | |
| 4,599,172 | A | 7/1986 | Gardes | |
| 4,744,420 | A | 5/1988 | Patterson et al. | |
| 4,844,156 | A * | 7/1989 | Hesh | 166/263 |
| 4,865,130 | A * | 9/1989 | Ware et al. | 166/303 |
| 5,033,550 | A | 7/1991 | Johnson et al. | |
| 5,211,242 | A | 5/1993 | Coleman et al. | |
| 5,316,081 | A | 5/1994 | Baski et al. | |
| 5,394,950 | A | 3/1995 | Gardes | |
| 5,402,851 | A | 4/1995 | Baiton | |
| 5,450,902 | A | 9/1995 | Matthews | |
| 5,680,901 | A | 10/1997 | Gardes | |
| 5,685,374 | A * | 11/1997 | Schmidt et al. | 166/369 |
| 5,720,356 | A | 2/1998 | Gardes | |
| 5,863,283 | A | 1/1999 | Gardes | |
| 6,016,702 | A * | 1/2000 | Maron | 73/705 |
| 6,065,550 | A | 5/2000 | Gardes | |
| 6,280,000 | B1 | 8/2001 | Zupanick | |
| 6,298,918 | B1 | 10/2001 | Franco et al. | |

(Continued)

FOREIGN PATENT DOCUMENTS

GB 2312727 11/1997

(Continued)

OTHER PUBLICATIONS

Notification of Transmittal of the International Search Report and the Written Opinion of the International Searching Authority, or the Declaration (2 pages), International Search Report (4 pages), and Written Opinion of the International Searching Authority (7 pages) for International Application No. PCT/US2005/046239 mailed Apr. 21, 2006.

(Continued)

*Primary Examiner*—David Bagnell
*Assistant Examiner*—Giovanna Collins
(74) *Attorney, Agent, or Firm*—Fish & Richardson P.C.

(57) ABSTRACT

A method for extracting accumulated material from a well bore includes pressurizing gas recovered from the well bore and disposing an extraction string in communication with a sump. The sump is disposed to receive liquid from the well bore. The method further includes sealing the sump and injecting at least a portion of the pressurized gas into the sump such that at least some of the liquid in the sump is driven upward into the extraction string.

23 Claims, 2 Drawing Sheets

U.S. PATENT DOCUMENTS 6,325,152 B1 12/2001 Kelley et al.
6,357,523 B1 3/2002 Zupanick
6,412,556 B1 7/2002 Zupanick
6,425,448 B1 7/2002 Zupanick et al.
6,439,320 B2 8/2002 Zupanick
6,454,000 B1 9/2002 Zupanick
6,457,540 B2 10/2002 Gardes
6,478,085 B2 11/2002 Zupanick
6,497,556 B2 12/2002 Zupanick et al.
6,561,288 B2 5/2003 Zupanick
6,575,235 B2 6/2003 Zupanick et al.
6,595,301 B1 7/2003 Diamond et al.
6,598,686 B1 7/2003 Zupanick
6,604,580 B2 8/2003 Zupanick et al.
6,604,910 B1 8/2003 Zupanick
6,629,566 B2 10/2003 Liknes
6,662,870 B1 12/2003 Zupanick et al.
6,668,918 B2 12/2003 Zupanick
6,668,931 B1 12/2003 Tomlinson et al.
6,672,392 B2 1/2004 Reitz
6,679,322 B1 1/2004 Zupanick
6,681,855 B2 1/2004 Zupanick et al.
6,688,388 B2 2/2004 Zupanick
6,708,764 B2 3/2004 Zupanick
6,722,452 B1 4/2004 Rial et al.
6,725,922 B2 4/2004 Zupanick
6,732,792 B2 5/2004 Zupanick
6,745,855 B2 6/2004 Gardes
6,848,508 B2 2/2005 Zupanick
6,851,479 B1 2/2005 Zupanick et al.
6,854,518 B1 2/2005 Senyard, Sr. et al.
6,923,275 B2 8/2005 Gardes
6,942,030 B2 9/2005 Zupanick
6,945,755 B2 9/2005 Zupanick et al.
6,968,893 B2 11/2005 Rusby et al.
2002/0096336 A1 7/2002 Zupanick et al.
2002/0189801 A1 12/2002 Zupanick et al.
2003/0217842 A1 11/2003 Zupanick et al.
2004/0007389 A1 1/2004 Zupanick
2004/0007390 A1 1/2004 Zupanick
2004/0011560 A1 1/2004 Rial et al.
2004/0031609 A1 2/2004 Zupanick
2004/0035582 A1 2/2004 Zupanick
2004/0050552 A1 3/2004 Zupanick
2004/0050554 A1 3/2004 Zupanick et al.
2004/0055787 A1 3/2004 Zupanick
2004/0084183 A1 5/2004 Zupanick
2004/0108110 A1 6/2004 Zupanick
2004/0118558 A1 6/2004 Rial et al.
2004/0140129 A1 7/2004 Gardes
2004/0149432 A1 8/2004 Zupanick
2004/0206493 A1 10/2004 Zupanick et al.
2004/0244974 A1 12/2004 Zupanick et al.
2005/0087340 A1 4/2005 Zupanick et al.
2005/0109505 A1* 5/2005 Seams ..... 166/263
2005/0115709 A1 6/2005 Zupanick et al.
2005/0133219 A1 6/2005 Zupanick
2005/0139358 A1 6/2005 Zupanick et al.
2005/0161216 A1 7/2005 Zupanick
2005/0161221 A1 7/2005 Diamond et al.
2005/0161258 A1 7/2005 Lockerd, Sr. et al.
2005/0167119 A1 8/2005 Diamond et al.
2005/0167156 A1 8/2005 Zupanick
2005/0189114 A1 9/2005 Zupanick
2005/0211471 A1 9/2005 Zupanick
2005/0211473 A1 9/2005 Zupanick
2005/0252689 A1 11/2005 Gardes

FOREIGN PATENT DOCUMENTS

WO WO 2005/026540 A2 3/2005

OTHER PUBLICATIONS

Gardes, Robert, "*A New Direction in Coalbed Methane and Shale Gas Recovery*," believed to have been first received at The Canadian Institute Coalbed Methane Symposium conference on Jun. 17, 2002, 7 pages.

Gardes, Robert, "*Under-Balanced Multi-Lateral Drilling for Unconventional Gas Recovery*," (to the best of Applicants' recollection, first received at The Unconventional Gas Revolution conference on Dec. 9, 2003, 30 pages.

Gardes, Robert, "Multi-Seam Completion Technology," Natural Gas Quarterly, E&P, Jun. 2004, pp. 78-81.

The Need for a Viable Multi-Seam Completion Technology for the Powder River Basin, Current Practice and Limitations, Gardes Energy Services, Inc., Believed to be 2003, 8 pages.

Gardes Directional Drilling, "Multiple Directional Wells From Single Borehole Developed," Reprinted from Jul. 1989 edition of Offshore, Copyright 1989 by PennWell Publishing Company, 4 pages.

Zupanick, et al, U.S. Patent Application entitled "Cavity Positioning Tool and Method," U.S. Appl. No. 10/188,159, filed Jul. 1, 2002.

Zupanick, U.S. Patent Application entitled "Method of Drilling Lateral Wellbores From a Slant Well Without Utilizing a Whipstock," U.S. Appl. No. 10/267,426, filed Oct. 8, 2002.

Zupanick, et al, U.S. Patent Application entitled "Cavity Positioning Tool and Method," U.S. Appl. No. 10/687,362, filed Oct. 14, 2003.

Zupanick, U.S. Patent Application entitled "Method and System for Circulating Fluid in a Well System," U.S. Appl. No. 11/188,250, filed Jul. 22, 2005.

Zupanick, U.S. Patent Application entitled "Enlarging Well Bores Having Tubing Therein," U.S. Appl. No. 11/019,694, filed Dec. 21, 2004.

Zupanick, U.S. Patent Application entitled "Perforating Tubulars," U.S. Appl. No. 11/019,748, filed Dec. 21, 2004.

Zupanick, U.S. Patent Application entitled "Accessing Subterranean Resources by Formation Collapse," U.S. Appl. No. 11/019,757, filed Dec. 21, 2004.

Notification of Transmittal of the International Preliminary Report on Patentability (1 page) and International Preliminary Report on Patentablility (10 pages) for International Application No. PCT/US2005/046239 mailed Apr. 30, 2007 (11 pages).

* cited by examiner

METHOD AND SYSTEM FOR CLEANING A WELL BORE

TECHNICAL FIELD

This invention relates generally to the recovery of subterranean deposits, and more particularly to a method and system for cleaning a well bore.

BACKGROUND

Subterranean zones that contain valuable deposits frequently include other materials, such as entrained water or solids, that are considered extraneous. Since such materials can interfere with the production of the valuable deposits, it may be desirable or necessary to have some way to remove extraneous materials from the production well bore. One method for handling extraneous, co-produced materials is to form a "sump" or "rat hole." The sump is a well bore drilled below the production well bore such that extraneous materials are allowed to fall into the sump and to collect therein. Sumps may be drilled vertically or obliquely from an existing well bore.

As materials are collected within the sump, the sump may become nearly or completely filled. In such instances, it is desirable to remove some of the collected material in order to provide sufficient capacity for new material to be collected in the sump. For example, a pump may be lowered into the sump, and water may be pumped to the surface. Such techniques permit the sump to be used to facilitate production after the capacity of the sump would ordinarily have been exhausted. Therefore, it is advantageous to have efficient and versatile methods for removing collected material from a sump. Furthermore, collected materials with a high solid content may present additional challenges for the removal process. For example, the solid phase material may obstruct the flow of collected material through pumps and potentially damage pump mechanisms. In another example, the relatively low liquid content of such collected materials may prove insufficient liquid flow to adequately lubricate and/or cool various types of pumping mechanisms. Consequently, it would be useful to have a technique for extracting collected material that can effectively remove materials with a high solid content as well.

SUMMARY

In a particular implementation, a method for extracting accumulated material from a well bore includes pressurizing gas recovered from the well bore and disposing an extraction string in communication with a sump. The sump is disposed to receive liquid from the well bore. The method further includes sealing the sump and injecting at least a portion of the pressurized gas into the sump such that at least some of the liquid in the sump is driven upward into the extraction string. In another implementation, 1. A system includes a compressor, a sump, a seal, a gas injection string, and an extraction string. The compressor pressurizes gas recovered from a well bore. The sump disposed receives liquid from the well bore. The seal seals the sump so that the sump is substantially airtight when sealed. The gas injection string is coupled to the compressor, and it injects at least a portion of the pressurized gas into the sump. The extraction string disposed within the sump such that at least some of the liquid in the sump is driven upward into the extraction string when the pressurized gas is injected into the sump.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
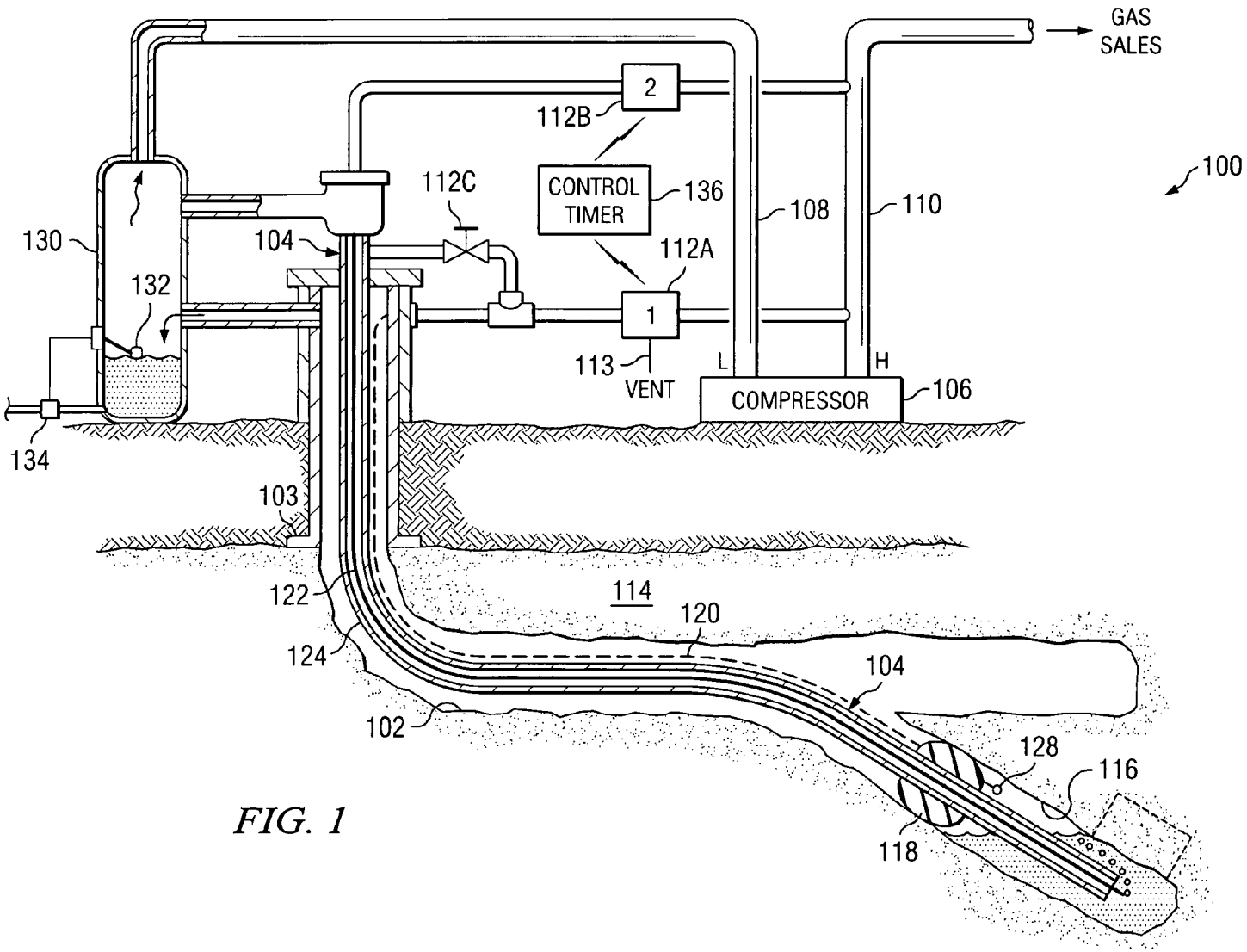
FIG. 1 illustrates a system for extracting liquid from a well bore in accordance with an implementation of the present invention.

FIG. 1 depicts a system 100 for cleaning a well bore 102. In the depicted implementation, system 100 includes a working string 104 and a compressor 106 with a low pressure line 108 and a high pressure line 110. System 100 also includes valves 112A and 112B coupled to high pressure line 110 that permit pressurized gas to be supplied to other parts of system 100. Overall, system 100 uses pressurized gas to remove undesired materials from well bore 102.

In the depicted embodiment, well bore 102 is an articulated well bore extending into a subterranean zone 114, such as a coal seam, in which there are subterranean deposits of natural gas, such as, for example, methane. An articulated well bore, such as the one depicted in FIG. 1, includes a first portion that is vertical, a second portion that is oriented within a plane of a subterranean zone, and a curved portion that connects the first and second portions. It should be understood that the described techniques are applicable to other types of well bores, and the articulated well bore is only one example. Well bore 102 may be reinforced using a tubular casing 103, which is any rigid material affixed (such as, for example, by cementing) within well bore 102. Although the described implementation describes a gas well, it should be understood that the described methods are also applicable to recover of a variety of materials from a subterranean zone, including natural gas, crude oil, associated solution gas, formation water, injected water, natural gas liquids, and numerous other subterranean minerals and solids. Within subterranean zone 114, there may be liquids and/or solids that could collect within the horizontal portion of well bore 102. The accumulation of such liquids and/or solids may interfere with the production of natural gas from well bore 102. Accordingly, there is a sump 116 drilled below the horizontal portion of well bore 102, allowing such liquids and solids to drain by gravity or reservoir pressure into sump 116. Sump 116 may be drilled using any suitable drilling technique, including any of the numerous well-known techniques for directional drilling. Although sump 116 is depicted as being drawn at an angle from well bore 102, it should be understood that the described techniques are equally applicable to a sump that is drilled vertically.

During gas production, gas produced from well bore 102 travels into a phase separation vessel 130, where the gas is allowed to flow upward while any entrained liquids and/or solids drop from suspension within phase separation vessel 130, so that phase separation vessel 130 also acts as a storage vessel 130 for entrained liquids and/or solids. Such entrained liquids and/or solids may include, for example, subterranean water from a coal seam. A floater 132 or other similar level indicator may be used to indicate when the liquid level in storage vessel 130 reaches a predetermined level. When the predetermined level is reached, drain 134 may be opened to drain accumulated liquids and solids from storage vessel 130. The gas, minus any removed liquids and solids, is then provided to low pressure line 108 of compressor 106. Compressor 106 pressurizes the gas and sends the pressurized gas out of high pressure line 110, which carries the pressurized gas to a sales or storage facility.

At the same time, subterranean liquids and/or solids within well bore 102 flow to sump 116, where they are collected. As liquids and/or solids accumulate within sump 116, sump 116 may eventually become filled to a level at which it becomes desirable to extract the accumulated material from the sump and produce them at the surface. In previous systems, a pump, such as an electric submersible pump, is placed within sump 116 to pump liquids to the surface through a tube or other conduit. The use of a pump to extract liquids incurs costs to purchase and operate pumps and also introduces technical challenges such as the need for a power and control system for the pump. Additionally, most conventional pumps do not adequately handle high volumes of entrained solids, and they may be damaged if they continue to run in a "pumped off" condition, such as after most of the accumulated material has been extracted Accordingly, it is advantageous to have an alternative technique for extracting liquids and/or solids from sump 116. Various implementations of the present invention provide such an alternative by using pressurized gas to extract liquid from sump 116.

Figure 2:
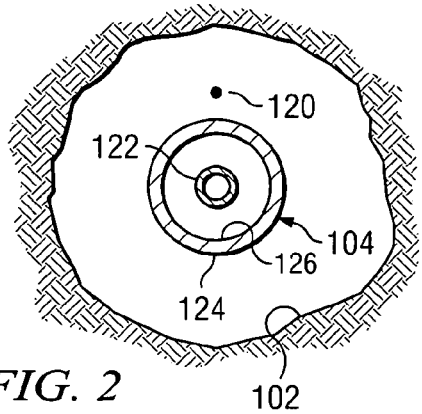
FIG. 2 illustrates a cross-sectional view of a working string in the system of FIG. 1.

In the depicted implementation, system 100 uses packer 118 to act as a seal for an annular space 126 (illustrated in the cross-sectional view of FIG. 2) between working string 104 and an interior of sump 116. Packer 118 may be any suitable device adapted to seal sump 116 in a substantially airtight manner. In the depicted implementation, packer 118 is an inflatable device comprising an expandable material, such as an elastomer or numerous other similar materials, that inflates to seal the annular space between working string 104 and sump 116. Packer 118 is controlled by a control string 120. Control string 120 is any suitable apparatus for causing packer 118 to seal and unseal sump 116. In the depicted implementation, control string 120 comprises tubing that couples high pressure line 110 of compressor 106 to packer 118 through valve 112A, which valve 112A also includes a vent 113 to the atmosphere. Valve 112A may be controlled by any suitable method, such as manual operation, electrically-controlled solenoid actuation, or numerous other methods for opening and closing valves. Valve 112A may thus be opened, closed, and/or vented to cause packer 118 to be inflated or deflated.

To seal sump 116, valve 112A is opened, allowing pressurized gas to flow through control string 120 into packer 118, thus expanding packer 118 to fill annular space 126. Once packer 118 is inflated, valve 112A may be closed to prevent gas from being driven back into high pressure line 110, such as, for example, by external pressure on packer 118. To unseal sump 116, vent 113 of valve 112A is opened, allowing the pressurized gas in packer 118 to escape into the atmosphere, which in turn deflates packer 118.

When sump 116 is sealed, working string 104 is used to inject pressurized gas into sump 116 and to recover gas from sump 116. In the depicted implementation, working string 104 includes a gas injection string 122 and an extraction string 124, which surrounds gas injection string 122 to define an annular space 126, as illustrated in the cross-sectional view of working string 104 shown in FIG. 2. Gas injection string 122 comprises tubing or other suitable conduit that couples sump 116 to high pressure line 110 of compressor 106 through valve 112B, which may be of a similar type to valve 112A. By opening valve 112B while sump 116 is sealed, a flow of pressurized gas through gas injection string 122 raises the pressure in sump 116, which in turn drives liquid into annular space 126. As the pressure in sump increases 116, accumulated material from sump 116 is carried to the surface by extraction string 124, which may be any suitable form of tubing or conduit for producing liquid and/or solid material to the surface. The produced liquids and/or solids are allowed to flow into storage vessel 130, where they accumulate along with the products dropped from suspension in the produced gas. As noted above, when the accumulated material exceeds a predetermined level, it may be drained from storage vessel 130 in order to prevent storage vessel 130 from overfilling.

Once the extraction of accumulated material from sump 116 is completed, valve 112B may be closed to stop the flow of pressurized gas, and packer 118 may be deflated to unseal sump 116 and to permit the pressurized gas in sump 116 to escape. The escaping gas is recovered at the surface along with the rest of the gas produced using well bore 102. To deflate packer 118, the gas in packer 118 is vented to the atmosphere through vent 113 of valve 112A. In an alternative implementation, another valve 112C may be used to couple control string 120 to a low pressure side of the well system. Such an implementation enables the gas used to inflate packer 118 to be recovered along with the other gas injected into sump 116. Further, the gas may be introduced into the extraction string 124, and the sudden entry of gas into extraction string 124 may create a pressure increase that can dislodge debris, such as loose coal or rocks from subterranean zone 114, that may become caught around the end of working string 104 as liquid enters extraction string 124.

A variety of techniques may be used to determine when to extract liquid from sump 116 and when sufficient liquid has been drained from sump 116. In some implementations, the inflation and deflation of packer 118 and the injection of gas is controlled by control timer 136. Control timer 136 is set to open and close valve 112A, 112B, and/or 112C so that sump 116 is periodically drained. In other implementations, the determination that sufficient liquid has been drained is based on reading a pressure sensor 128 coupled to packer 118 that measures gas and/or liquid pressure. In such an implementation, control string 120 may include an insulated wire or any of numerous other media for carrying signals from pressure sensor 128 to the surface. In an example of operation, pressure sensor 128 may measure the liquid pressure resulting from accumulated liquid in sump 116. When the pressure exceeds a certain amount, accumulated material is extracted from sump 116. In another example, pressure sensor 128 may monitor the gas pressure in sealed sump 116, and once the gas pressure reaches a predetermined level deemed sufficient to indicate that most of the accumulated material in sump 116 has been driven to the surface, sump 116 may be unsealed. Alternatively, a pressure sensor, which may be located on the surface, may be coupled to the gas injection string 122 to monitor the pressure of a constant, low-volume flow of gas. Rising pressure would then indicate an increase in the level of accumulated material. When the pressure reaches a predetermined threshold level, accumulated material is extracted from sump 116. The implementations described here are merely examples, and it should be understood that numerous other methods for determining when to extract accumulated material from sump 116 and when to unseal sump 116 may be employed.

Figure 3:
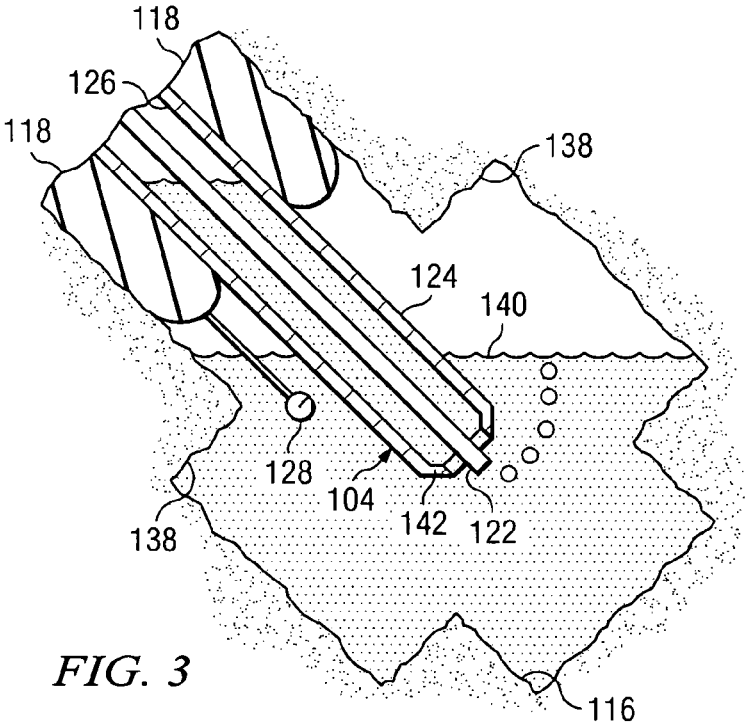
FIG. 3 illustrates a downhole portion of a system for extracting liquid from a well bore.

FIG. 3 illustrates an implementation of a downhole portion of working string 104. In the depicted implementation, sump 116 has been provided with cavity portions 138 extending transversely to the longitudinal axis of sump 116. Cavity portions 138 increase the capacity of sump 116 to contain liquid. Pressure sensor 128 is a liquid pressure sensor that is placed to measure the liquid level 140 within sump 116 in order to facilitate the determination of when to extract liquid from sump 116. In the depicted implementation, extraction string 124 includes a flared, end 142. End 142 may be flared inward in order to prevent larger debris in sump 116 from being pulled into annular space 126 by the flow of liquid and gas into extraction string 124. This tends to prevent extraction string 124 from becoming obstructed or clogged by such debris.

Figure 4:
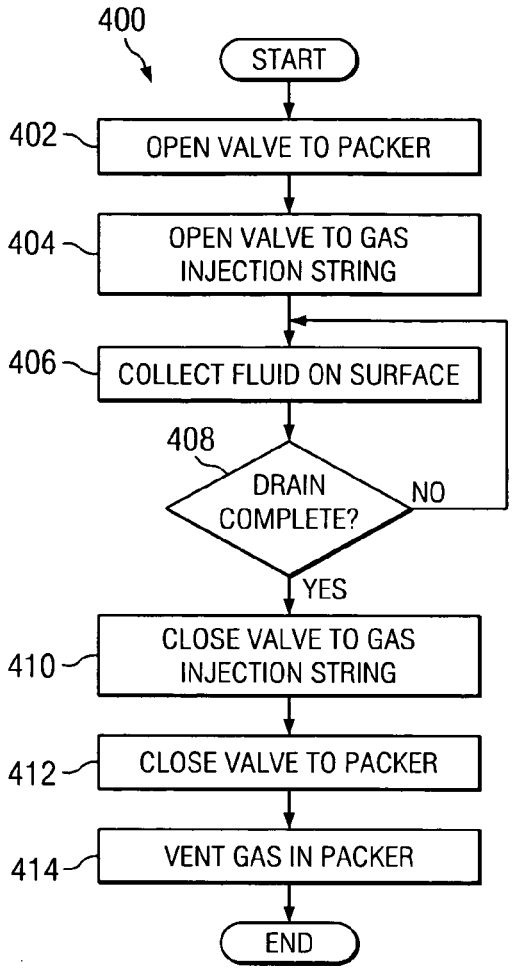
FIG. 4 illustrates a method for extracting liquid from a well bore in accordance with another implementation of the present invention.

FIG. 4 illustrates an example of a method for extracting accumulated material from sump 116 using injection of pressurized gas. At step 402, valve 112A coupling packer 118 to high pressure line 110 is opened, inflating packer 118 and sealing sump 116. Once packer 118 is inflated, valve 112A to packer 118 may be closed at step 404. In alternative implementations, valve 112A may be left open. Valve 112B coupling gas injection string 122 to high pressure line 110 is opened at step 406. This causes the pressure in sump to rise, thus driving accumulated liquid and solid material into annular space 126 within extraction string 124 and eventually to the surface. Liquids and/or solids are collected in storage vessel 130 at step 408. Accumulated material may be drained out of storage vessel 130 to prevent storage vessel 130 from overfilling.

The removal process continues until the drainage of sump 116 has been completed, as shown at decision step 410. The determination of when the drainage is completed may be made based on elapsed time, measured changes in pressure, or any other suitable method, including any of those described herein. Once the drainage is completed, valve 112B is closed at step 412. The gas within packer 118 is then vented at step 414, thus unsealing sump 116. The gas from packer 118 may be vented in any suitable manner, including venting the gas to the atmosphere using valve 112A or venting the gas back into extraction string 124.

A number of embodiments of the invention have been described. Nevertheless, it will be understood that various modifications may be made without departing from the spirit and scope of the invention. For example, the described techniques may be used to extract any manner of liquids and solids from any type of subterranean well drilled using any suitable technique. In another example, the extraction string may be separated from the gas injection string, so that the extraction string does not enclose the gas injection string. Accordingly, other embodiments are within the scope of the following claims.

What is claimed is:

1. A system, comprising:

a compressor operable to pressurize gas recovered from a well bore;

a sump disposed to receive liquid from the well bore;

a seal operable to seal the sump, wherein the sump is substantially airtight when sealed;

a gas injection string coupled to the compressor and operable to inject at least a portion of the pressurized gas into the sump; and an extraction string disposed within the sump such that at least some of the liquid in the sump is driven upward into the extraction string when the pressurized gas is injected into the sump, wherein:

the seal comprises an inflatable packer; and the packer is inflated using at least a portion of the pressurized gas.

2. The system of claim 1, further comprising a valve coupled to the packer and to the gas injection string, wherein the valve is operable to allow the pressurized gas used to inflate the packer to flow into the gas injection string.

3. The system of claim 1, further comprising a valve coupled to the packer operable to vent the pressurized gas used to inflate the packer to the atmosphere.

4. The system of claim 1, wherein the sump further comprises at least one cavity portion extending transversely to the longitudinal axis of the sump.

5. The system of claim 1, wherein:

the extraction string surrounds the gas injection string so as to define an annular space between the extraction string and the gas injection string; and the liquid from the sump is driven upward into the annular space when the pressurized gas is injected into the sump.

6. The system of claim 5, wherein the extraction string comprises a flared end, the flared end flared inwardly to prevent debris from entering the annular space.

7. The system of claim 1, further comprising a pressure sensor operable to measure at least one of a gas pressure or a liquid pressure in the sump.

8. The system of claim 1, further comprising a control timer operable to cause the packer to seal the sump and further operable to cause the gas injection string to inject the pressurized gas into the sump.

9. The system of claim 1, further comprising a vessel on a surface above the well bore operable to collect liquid driven upward into the extraction string.

10. The system of claim 1, wherein the extracted liquid comprises suspended solids.

11. A method for extracting accumulated material from a well bore, comprising:

pressurizing gas recovered from the well bore;

disposing an extraction string in communication with a sump, wherein the sump is disposed to receive liquid from the well bore;

sealing the sump; and injecting at least a portion of the pressurized gas into the sump such that at least some of the liquid in the sump is driven upward into the extraction string, wherein:

the sump is sealed using an inflatable packer; and the step of sealing the sump comprises inflating the packer using at least a portion of the pressurized gas.

12. The method of claim 11, further comprising:

deflating the packer; and allowing the pressurized gas used to inflate the packer to flow into the extraction string.

13. The method of claim 11, further comprising venting the pressurized gas used to inflate the packer into the atmosphere.

14. The method of claim 11, further comprising:

measuring a gas pressure within the sump; and unsealing the sump when the gas pressure reaches a predetermined amount.

15. The method of claim 11, further comprising:

measuring a liquid pressure within the sump; and performing the steps of sealing the sump and injecting at least a portion of the pressurized gas in response to detecting that the liquid pressure has reached a predetermined amount.

16. The method of claim 11, further comprising:

unsealing the sump;

timing a predetermined time interval; and repeating the steps of sealing, injecting, and unsealing each time the predetermined time interval elapses.

17. The method of claim 11, further comprising collecting liquid driven upward into the extraction string at a storage vessel on a surface above the well bore.

18. The method of claim 11, wherein the sump comprises an enlarged cavity portion extending transversely from a longitudinal axis of the sump.

19. The method of claim 11, wherein the liquid comprises suspended solids.

20. A system, comprising:

a compressor operable to pressurize gas recovered from a well bore;

a sump disposed to collect liquid from the well bore, wherein the sump comprises at least one cavity portion drilled transversely to the drilling direction of the sump;

a packer coupled to the compressor, the packer operable to be inflated using at least a portion of the pressurized gas, wherein the packer, when inflated, seals the sump such that the sump is substantially airtight;

a gas injection string in communication with the sump and coupled to the compressor, the gas injection string operable to inject pressurized gas into the sump; and an extraction string surrounding the gas injection string so as to define an annular space between the extraction string and the gas injection string, wherein liquid from the sump is driven upward into the annular space when the pressurized gas is injected into the sump, the extraction string comprising a flared end flared inwardly in order to prevent debris from entering the annular space.

21. A method for extracting accumulated material from a wellbore, comprising:

pressurizing gas recovered from the well bore;

disposing an extraction string in communication with a sump, wherein the sump is disposed to receive liquid from the well bore;

sealing the sump;

injecting at least a portion of the pressurized gas into the sump such that at least some of the liquid in the sump is driven upward into the extraction string;

measuring a gas pressure within the sump; and unsealing the sump when the gas pressure reaches a predetermined amount.

22. A method for extracting accumulated material from a well bore, comprising:

pressurized gas recovered from the well bore;

disposing an extraction string in communication with a sump, wherein the sump is disposed to receive liquid from the well bore;

sealing the sump;

injecting at least a portion of the pressurized gas into the sump such that at least some of the liquid in the sump is driven upward into the extraction string;

measuring a liquid pressure within the sump; and preforming the steps of sealing the sump and injecting at least a portion of the pressurized gas in response to detecting that the liquid pressure has reached a predetermined amount.

23. A method for extracting accumulated material from a well bore, comprising:

pressurizing gas recovered from the well bore;

disposing an extraction string in communication with a sump, wherein the sump is disposed to receive liquid from the well bore;

sealing the sump;

injecting at least a portion of the pressurized gas into the sump such that at least some of the liquid in the sump is driven upward into the extraction string;

unsealing the sump;

timing a predetermined time interval; and repeating the steps, injecting, and unsealing each time the predetermined time interval elapses.

* * * * *

UNITED STATES PATENT AND TRADEMARK OFFICE

CERTIFICATE OF CORRECTION

PATENT NO. : 7,311,150 B2
APPLICATION NO. : 11/018775
DATED : December 25, 2007
INVENTOR(S) : Joseph A. Zupanick It is certified that error appears in the above-identified patent and that said Letters Patent is hereby corrected as shown below:

Col. 5, Line 16, delete "," after flared

Col. 7, Line 43, replace "wellbore" with -- well bore --

Col. 8, Line 14, replace "pressurized" with -- pressurizing --

Col. 8, Line 23, replace "preforming" with -- performing --

Col. 8, line 40, insert -- of sealing -- after "the steps"

Signed and Sealed this

Twenty-fourth Day of June, 2008

JON W. DUDAS
*Director of the United States Patent and Trademark Office*